US007275976B2

(12) United States Patent
Toriyama et al.

(10) Patent No.: US 7,275,976 B2
(45) Date of Patent: Oct. 2, 2007

(54) GAME TOY DEVICE USING REMOTE-CONTROLLED TRAVELING TOY, REMOTE-CONTROLLED TRAVELING TOY, AND GAME BOARD

(75) Inventors: Ryosuke Toriyama, Kanagawa (JP); Ryoji Hayashi, Kanagawa (JP); Makoto Umeno, Kanagawa (JP)

(73) Assignee: Konami Digital Entertainment Co., Ltd., Tokyo (JP)

( * ) Notice: Subject to any disclaimer, the term of this patent is extended or adjusted under 35 U.S.C. 154(b) by 45 days.

(21) Appl. No.: 10/526,987

(22) PCT Filed: Mar. 24, 2004

(86) PCT No.: PCT/JP2004/004066

§ 371 (c)(1),
(2), (4) Date: Mar. 7, 2005

(87) PCT Pub. No.: WO2004/087275

PCT Pub. Date: Oct. 14, 2004

(65) Prior Publication Data

US 2006/0009120 A1 Jan. 12, 2006

(30) Foreign Application Priority Data

Mar. 28, 2003 (JP) ..... 2003-092957
Jan. 6, 2004 (JP) ..... 2004-001492

(51) Int. Cl.
*A63H 30/00* (2006.01)
*A63H 18/00* (2006.01)

(52) U.S. Cl. ..... 446/454; 446/444

(58) Field of Classification Search ..... 446/431, 446/433, 437, 444, 445, 454, 456, 460; 238/10 R; 273/246

See application file for complete search history.

(56) References Cited

U.S. PATENT DOCUMENTS 2,949,682 A * 8/1960 Humbert ..... 434/140
3,462,148 A * 8/1969 Fors ..... 273/116
3,559,990 A * 2/1971 Philpot ..... 473/109
4,251,949 A * 2/1981 Buck et al. ..... 446/444
D289,218 S * 4/1987 Divnick ..... D99/34

(Continued)

FOREIGN PATENT DOCUMENTS

GB 2328621 A * 3/1999

(Continued)

*Primary Examiner*—Eugene Kim
*Assistant Examiner*—Alyssa M Hylinski
(74) *Attorney, Agent, or Firm*—Rankin, Hill, Porter & Clark LLP

(57) ABSTRACT

The present invention provides a play toy system using a remote-controlled traveling toy, which enables the remote-controlled traveling toy to make a movement that is more unexpected than before, for play. The remote-controlled traveling toy 1 includes one front wheel 5 and two rear wheels 7 and 9. The traveling toy is remotely controlled by remote control signals and is so constructed as to travel on a traveling surface of a play board. The diameter sizes of the two rear wheels 7 and 9 are different. With one front wheel 5 and two rear wheels 7, 9 having a different diameter, the remote-controlled traveling toy 1 can move most unexpectedly that anyone has ever experienced, according to the state of the traveling surface of the play board.

9 Claims, 7 Drawing Sheets

U.S. PATENT DOCUMENTS

| | | | | |
|---|---|---|---|---|
| 5,203,733 | A * | 4/1993 | Patch et al. | 446/444 |
| 5,683,298 | A | 11/1997 | Jackson | |
| 6,074,271 | A * | 6/2000 | Derrah | 446/457 |
| 2002/0137428 | A1* | 9/2002 | Tibor et al. | 446/465 |

FOREIGN PATENT DOCUMENTS

| | | | |
|---|---|---|---|
| JP | 2-143997 | | 12/1990 |
| JP | 4-44792 | | 2/1992 |
| JP | 6-71056 | | 3/1994 |
| JP | 6-114167 | | 4/1994 |
| JP | 7-155476 | | 6/1996 |
| JP | 2000-325671 | | 11/2000 |
| JP | 2000325671 | A * | 11/2000 |
| JP | 3082469 | | 9/2001 |
| JP | 2002-000962 | | 1/2002 |
| JP | 3092080 | | 11/2002 |

* cited by examiner

GAME TOY DEVICE USING REMOTE-CONTROLLED TRAVELING TOY, REMOTE-CONTROLLED TRAVELING TOY, AND GAME BOARD

TECHNICAL FIELD

The present invention relates to a play toy system using a remote-controlled traveling toy, a remote-controlled traveling toy, and a play board.

BACKGROUND ART

There have been hitherto known play toy systems played by causing remote-controllable traveling toys to compete with each other. Japanese Patent Application Laid-Open Publication No. 000962/2002 discloses a play toy system played by making remote-controllable top toys travel on the travel surface of a play board and then flipping the top toy of an opponent out of the play board or knocking down the top toy of the opponent. Japanese Utility Model Registration Publication No. 3092080 discloses an example of a play board for top toys, provided with a plurality of concave portions in the central portion thereof for receiving magnets.

The players' interest cannot be enhanced simply by causing the remote-controlled traveling toys to compete with each other as in the prior art, because the traveling toy does not make an unexpected movement. In the case of the play toy system like the one described in Japanese Patent Application Laid-Open Publication No. 000962/2002 in which the traveling toy is the top toy which turns on a pivot, in order to cause the top toy to make the unexpected movement, it is necessary to use a permanent magnet or the like to change the course of the top toy, as on the play board disclosed in Japanese Utility Model Registration No. 3092080. Alternatively, it is necessary to use a play board provided with a special equipment such as a rotating board, like the play board disclosed in Japanese Utility Model Registration No. 3082469. Further, with the top toy, a sudden increase or decrease of the speed of the traveling toy cannot be attained, so that it is difficult to obtain a feeling of speed.

Accordingly, an object of the present invention is to provide a play toy system using a remote-controlled traveling toy which enables the remote-controlled traveling toy to make a movement that is more unexpected than before, for play.

Another object of the present invention is to provide a play toy system using a remote-controlled traveling toy, in which the remote-controlled traveling toy is difficult to be tumbled or turned over and can be played with stability.

Yet, another object of the present invention is to provide a play toy system using a remote-controlled traveling toy that can be controlled to a sufficient degree even if a speed thereof is increased.

Still another object of the present invention is to provide a play board and a play toy system using a remote-controlled traveling toy that enables the remote-controlled traveling toy to make an unexpected movement to a sufficient degree just by increasing or decreasing a speed thereof.

DISCLOSURE OF THE INVENTION

A play toy system using a remote-controlled traveling toy according to the present invention includes a remote control device for outputting a remote control signal, a remote-controlled traveling toy including one front wheel, two rear wheels, and an electric motor remote controlled by the remote control signal, and a play board having a travel surface on which the remote-controlled traveling toy travels. In the present invention, the diameter sizes of the two rear wheels of the remote-controlled traveling toy are made to be different. When a single front wheel is used with the diameter sizes of the rear wheels made to be different, an unexpected movement that has not been experienced before can be made by the remote-controlled traveling toy, according to the state of the travel surface. For this reason, compared with a mere remote control, a much unexpected movement can be made by the remote-controlled traveling toy, for play, even if control can be exercised. Especially if this unexpectedness is actively used not only when competing with the remote-controlled traveling toy of an opponent but also when escaping from the toy of the opponent, a thrilling play can be experienced.

Since the remote-controlled traveling toy makes an unexpected movement, fine control rather becomes an obstacle to speeding up as well as a cause of reducing controllability. Thus, as the remote control device, the simple one is suitable that includes a switch to be operated for outputting a signal for rotating the electric motor at a normal speed and an acceleration switch to be operated for outputting an acceleration signal for rotating the electric motor at a speed faster than the normal speed. When such the simple remote control device is employed, what angle is set for the front wheel before the start of a play greatly affects subsequent control. Thus, setting the angle of the front wheel also becomes part of the play, so that the interest of players can be more enhanced.

When the diameter sizes of the two rear wheels are made to be different, the body of the remote-controlled traveling toy becomes inclined. Thus, depending on the angle of traveling, tumbling or turning over will readily occur. Thus, preferably, in the body, one or more batteries connected to the electric motor are juxtaposedly arranged so that longitudinal axes thereof extend in the same direction as a direction in which the two rear wheels are arranged. In other words, preferably, the batteries are arranged so that the longitudinal axes thereof extend in directions that cross the center line of the body of the traveling toy extends in the longitudinal direction of the body. With this arrangement, not only the center of gravity becomes lower but also a stable operation with respect to the lateral movement of the body can be obtained. Accordingly, even when inclination of the travel surface of the play board is sharp or complicated, tumbling will not readily occur, so that unexpected yet stable traveling can be obtained. Incidentally, when the electric motor is-arranged between the two rear wheels and the one or more batteries are arranged between the electric motor and the front wheel, more stable traveling can be obtained.

The angle setting of the front wheel of the remote-controlled traveling toy can be changed, and the wheel sections of the front wheel and the rear wheels are so formed that a dynamic friction resistance between the play board and the front wheel becomes smaller than dynamic friction resistances between the rear wheels and the play board. When such the play toy system is used, the movement of the remote-controlled traveling toy can be made to be complicated, so that a more unexpected movement can be implemented. Incidentally, when the dynamic friction resistance between the front wheel and the play board is too small, the remote-controlled traveling toy is apt to slip during traveling, so that the controllability of the remote-controlled traveling toy is reduced. Thus, the wheel section of the front wheel is formed of an ethylene polymer including high-density polyethylene and low-density polyethylene. With this arrangement, due to the presence of the low-density polyethylene, the surface roughness of the front wheel of the remote-controlled traveling toy becomes coarse. Thus, the dynamic friction resistance of the front wheel can be increased more than in the case where no high-density polyethylene is included, so that the controllability of the remote-controlled traveling toy can be maintained. Incidentally, as a result of study by the inventor, it was found that if the low-density polyethylene accounts for 30 weight percents or less of the ethylene polymer, the controllability of the remote-controlled traveling toy could be maintained most effectively.

In principle, any board may be used as the play board. However, it is preferable that the travel surface of the play board as well is so designed as to take advantage of the difference in the diameters of the rear wheels and obtain more unexpected traveling. When the travel surface is continuous in a circumferential direction and is shaped so that a height thereof from an installation surface is decreasing toward a central portion thereof, for example, a concave section is formed that has a size capable of fully receiving the front wheel and/or the rear wheels and a depth allowing the remote-controlled traveling toy to get out of there by itself is formed. Depending on the size and depth of the concave section and the speed of the remote-controlled traveling toy, the remote-controlled traveling toy falls into a state in which it is incapable of traveling or incapable of getting out of the concave section. In other words, this is when the front wheel and all of the rear wheels have fallen into the concave section and the speed of the remote-controlled traveling toy cannot be increased to a necessary and sufficient speed or when the body or an exterior attached to the body is caught by the inner wall of the concave section and advancement cannot be made with part or all of the wheels fallen into the concave section. When such the concave portion is formed in the central portion and one of the rear wheels has fallen into the concave section, the remote-controlled traveling toy may abruptly make a reversed movement. A more unexpected movement can be thereby given to the remote-controlled traveling toy. Further, when the state, in which the traveling toy is incapable of getting out from the concave section, is defined as a losing condition of the competition play, the play will not become boring. Unlike a competition play which involves just escaping around, the play will become more interesting because a fall into the concave section occurs during an escape around a lower area.

Incidentally, the study by the inventor has found that when an angle between the inner periphery surface of the concave section and the installation surface was set in the angle range of 93±1°, it was probable that an unexpected movement would be generated when one of the rear wheels fell into the concave section.

It was also found that when the main portion of the travel surface was constituted by a first inclined surface adjacent to the concave section and having a first radius of curvature and a second inclined surface continuous with the outside of the first inclined surface and having a second radius of curvature close to infinity and the angle of the second inclined surface from the installation surface was set in the angle range of 32.2° to 42.2°, an unexpected movement could be obtained. The unexpected movement includes the one in which the remote-controlled traveling toy having different diameters of the read wheels abruptly ascends upward to the top of the second inclined surface upon getting into the first inclined surface. Accordingly, from a technical viewpoint, these radiuses of curvature and the angle range have noticeable effects.

Further, the effect of changing the diameter sizes of the two rear wheels of the remote-controlled traveling toy can be made to be more outstanding when the travel surface is constituted by a first inclined surface adjacent to the concave section and having a first radius of curvature, a second inclined surface continuous with the outside of the first inclined surface and having a second radius of curvature close to infinity, a third inclined surface continuous with the outside of the second inclined surface and having a third radius of curvature smaller than the first radius of curvature, and a fourth inclined surface continuous with the outside of the third inclined surface and having a fourth radius of curvature smaller than the third radius of curvature, when width sizes are set to become smaller in the order of the second inclined surface, first inclined surface, third inclined surface, and fourth inclined surface, and when the angle of the second inclined surface from the installation surface is set in the angle range of 32.2° to 42.2°.

Then, when an angle between the third inclined surface and the installation surface is set in the angle range of 48±2°, when an angle between the fourth inclined surface and the installation surface is set in the angle range of 89±1°, or when substantially a horizontal surface is provided outside the fourth inclined surface, an unexpected or unpredictable movement can be made in each case by the remote-controlled traveling toy. Incidentally, a combination of these angle ranges may be changed as necessary according to the condition of the wheels of the remote-controlled traveling toy and the like. The remote-controlled traveling toy and the play board used in the present invention in themselves have technically excellent features. Though they have a simple configuration with small number of parts, they can be amusingly played with both by children and adults.

BEST MODE FOR CARRYING OUT THE INVENTION

Figure 1:
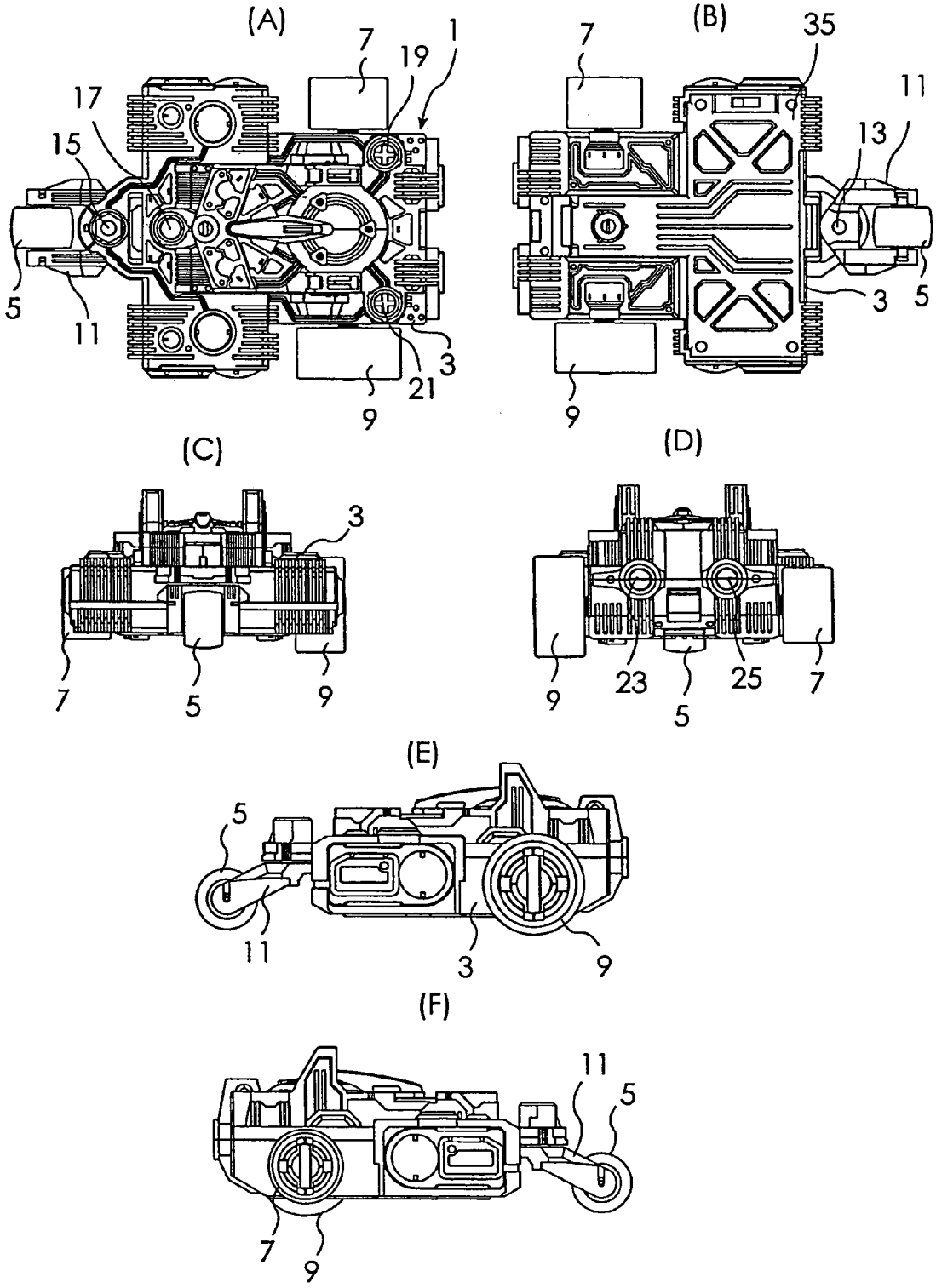
FIGS. 1(A) through 1(F) are a plan view, a bottom view, a front view, a rear view, a left side view, and a right side view of a remote-controlled traveling toy according to an embodiment of the present invention, suitable for use in a play toy system using a remote-controlled traveling toy of the present invention.

An example of an embodiment of the present invention will be described below in detail with reference to the drawings.

FIGS. 1(A) through 1(F) are a plan view, a bottom view, a front view, a rear view, a left side view, and a right side view of a remote-controlled traveling toy 1 according to an embodiment of the present invention, suitable for use in a play toy system using a remote-controlled traveling toy of the present invention. This remote-controlled traveling toy 1 includes one front wheel 5 to the front of a body 3 and two rear wheels 7 and 9 to the rear of the body 3. The diameter of the front wheel 5 is the smallest of the three wheels. Then, the diameter sizes of the two rear wheels 7 and 9 are different. When the diameter size of the rear wheel 9 is set to 1, the diameter size of the rear wheel 9 and the diameter size of the rear wheel 7 are in the relation of approximately 1:0.8. With regard to the geometries and structure of the remote-controlled traveling toy in this embodiment, when the diameter of the rear wheel having the larger diameter size is set to 1, it is preferable that the ratio of the diameter sizes of the rear wheels is set in the range of 1:0.738 to 1:0.775. If the ratio is set within this range, a difference in the diameter sizes does not become an obstacle to traveling, and moreover, an unexpected traveling characteristic can be obtained. Incidentally, the preferable ratio is not limited to the above-mentioned example, and is changed depending on a combination of the shape and size of the body of the traveling toy, the material of the rear wheels, the size of the play board, and the angle and material of an inclined surface and the like.

An angle setting of front wheel supporting arms 11 by which the front wheel 5 is supported can be changed within a predetermined angle range with respect to a rotation center 13. In order to keep the angle setting unchanged during traveling, a click mechanism may be provided in a rotation mechanism thereof.

Figure 2:
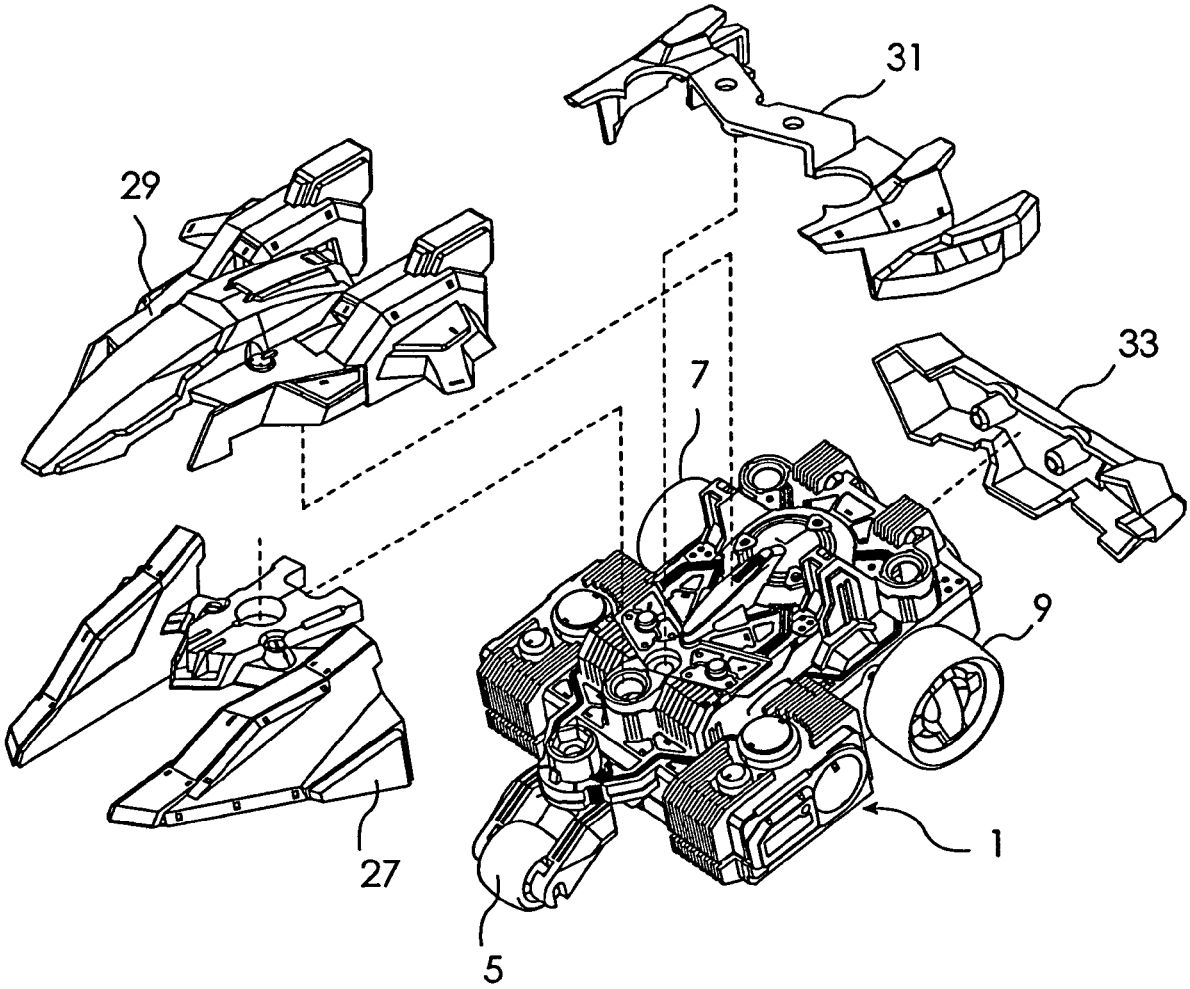
FIG. 2 is an exploded perspective view used for explaining attachment of exterior parts.

Six attached sections 15 through 25 for attaching exterior parts thereto are provided on the top surface and the rear surface of the body 3. Four types of exterior parts 27 through 33 shown in FIG. 2 can be attached to these attached sections 15 through 25. It is not essential to attach these exterior parts 27 through 33. They may be attached according to preference of the player. Exterior parts having shapes other than those shown in FIG. 2 may be of course attached.

Figure 3:
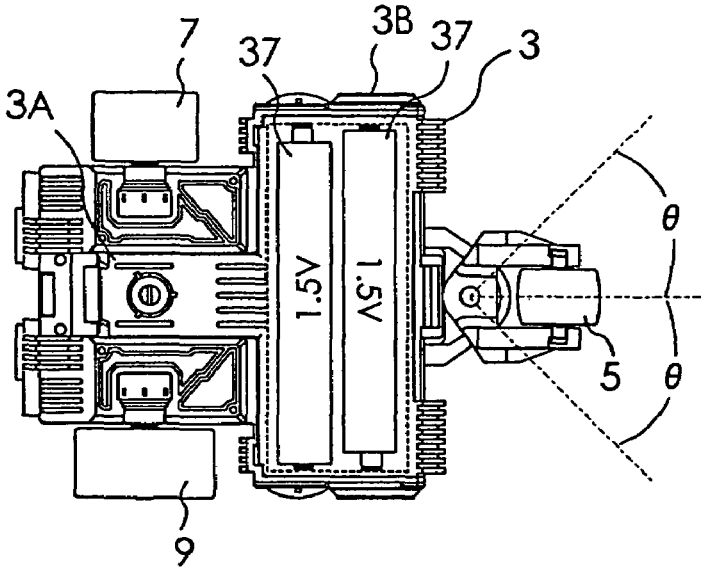
FIG. 3 is a bottom view of the remote-controlled traveling toy with a battery cover thereof removed.

FIG. 3 shows a bottom view of the remote-controlled traveling toy 1 with a battery cover 35 removed. In this remote-controlled traveling toy, an electric motor is arranged in the rear area of the body 3 located between the two rear wheels 7 and 9. Then, two batteries 37 are arranged in a front area 3B between the electric motor and the front wheel. Incidentally, circuit boards for a wireless communication circuit and the control circuit of the electric motor may be arranged in either of a rear area 3A and the front area 3B. In this example, the circuit boards are arranged in the rear area 3A. The two batteries 37 are juxtaposedly arranged so that the longitudinal axes thereof extend in the same direction as the direction in which the two rear wheels 7 and 9 are arranged, or the longitudinal axes thereof cross the center line of the body of the traveling toy extending in the longitudinal direction of the body. Specifically, the batteries 37 are so arranged that the axes of the rear wheels 7 and 9 and the longitudinal axes of the batteries 37 become parallel. With this arrangement, not only the center of gravity becomes lower but also a stable operation with respect to the lateral movement of the body can be obtained. Accordingly, even when inclination of the travel surface of the play board is sharp or complicated, tumbling will not readily occur, so that unexpected yet stable traveling can be obtained.

The angle of the front wheel 5 of the remote-controlled traveling toy 1 is adjusted so as to enable angle setting to be changed. Specifically, the front wheel 5 is fixed to the attached section 15 so as to be rotatable within the angle range of ±45 degrees with respect to the axis line in the longitudinal direction of the remote-controlled traveling toy 1. Then, the dynamic friction resistance between the front wheel 5 and the play board is formed to be smaller than the dynamic friction resistances between the rear wheel 7 and the play board and between the rear wheel 9 and the play board. In this embodiment, the wheel section of the front wheel 5 is formed of an ethylene polymer, and the rear wheels 7 and 9 are formed of a rubber-based material. With this arrangement, movements of the remote-controlled traveling toy can be made to be complicated, so that a more unexpected movement can be implemented. In this embodiment, the wheel section of the front wheel 5 is formed of an ethylene polymer including low-density polyethylene and high-density polyethylene, and specifically, the low-density polyethylene accounts for 30 weight percents or less of the ethylene polymer. Due to the presence of the low-density polyethylene, the surface roughness of the wheel section of the front wheel 5 becomes coarse. Thus, the dynamic friction resistance of the front wheel can be increased more than in the case where no low-density polyethylene is included, so that the controllability of the remote-controlled traveling toy can be maintained. Incidentally, in order to maintain the controllability of the remote-controlled traveling toy most effectively, in this embodiment, the ethylene polymer in which the low-density polyethylene and the high-density polyethylene are compounded at rates of 20 weight percents and 80 weight percents, respectively is employed as the material of the wheel section of the front wheel 5.

Figure 4:
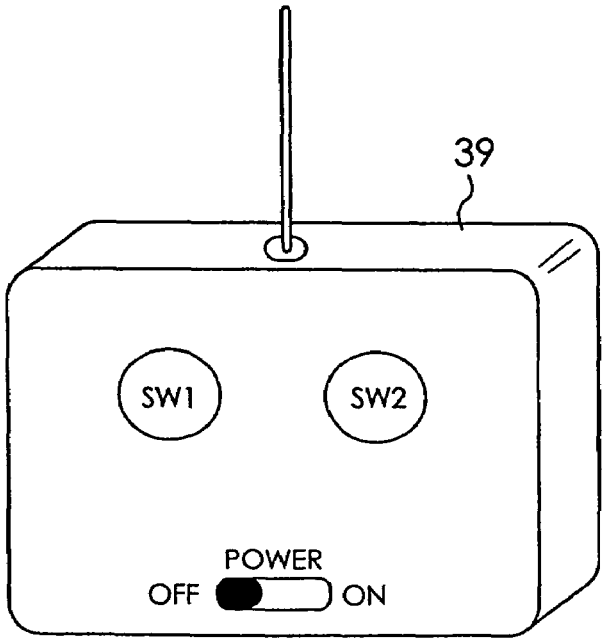
FIG. 4 is a perspective view showing an outward appearance of an example of a remote control device used in this embodiment.

FIG. 4 is a perspective view showing an outward appearance of an example of a remote control device 39 used in this embodiment. This remote control device 39 has a simple configuration equipped with only two control switches of a switch SW1 to be operated for outputting a signal for rotating the electric motor at a normal speed and an acceleration switch SW2 to be operated for outputting an acceleration signal for rotating the electric motor at a speed faster than the normal speed. When the acceleration switch SW2 is depressed, the speed is set to several times the speed when the switch SW1 is depressed. When the switch SW1 is kept on being depressed, the toy travels substantially at a certain speed. When the switch SW1 is released, power distribution to the electric motor is stopped, so that the speed is decreased. Then, when the acceleration switch SW2 is depressed with the switch SW1 being depressed, abrupt acceleration is performed at a predetermined acceleration from the normal rotational speed. A command (the acceleration signal) from the acceleration switch SW2 may be transmitted only while the switch SW1 is depressed. However, even when the acceleration switch SW2 alone is depressed while the switch SW1 is not depressed, the acceleration signal may be transmitted. Either of wireless remote control or infrared remote control may be exercised. When such the simple remote control device 39 is employed, what angle is set for the front wheel 5 before the start of a play greatly affects later control. Thus, setting the angle of the front wheel 5 also becomes part of the play.

Figure 5:
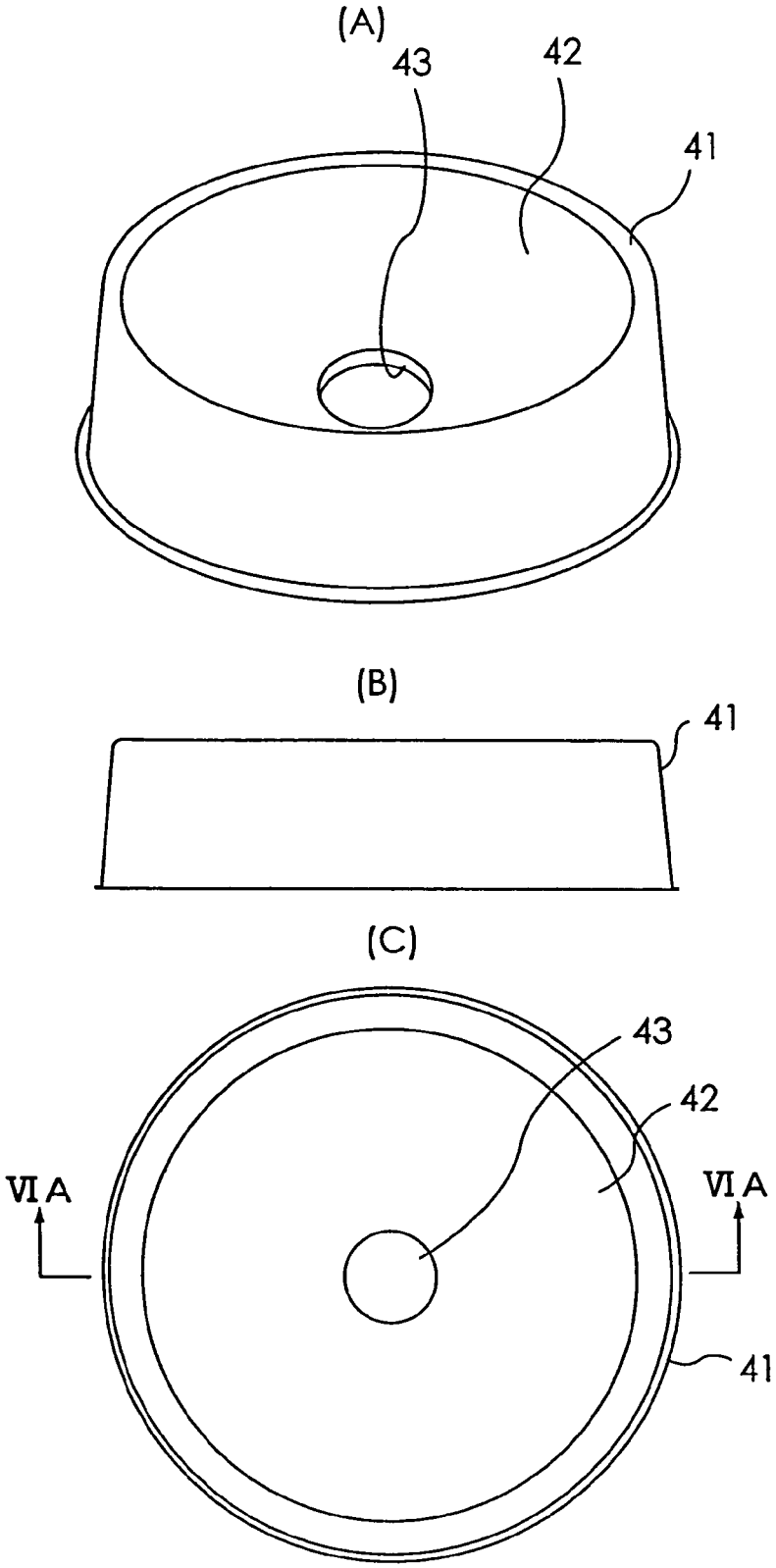
FIGS. 5(A) through 5(C) are perspective views showing outward appearances of an example of a play board used in this embodiment.
Figure 6:
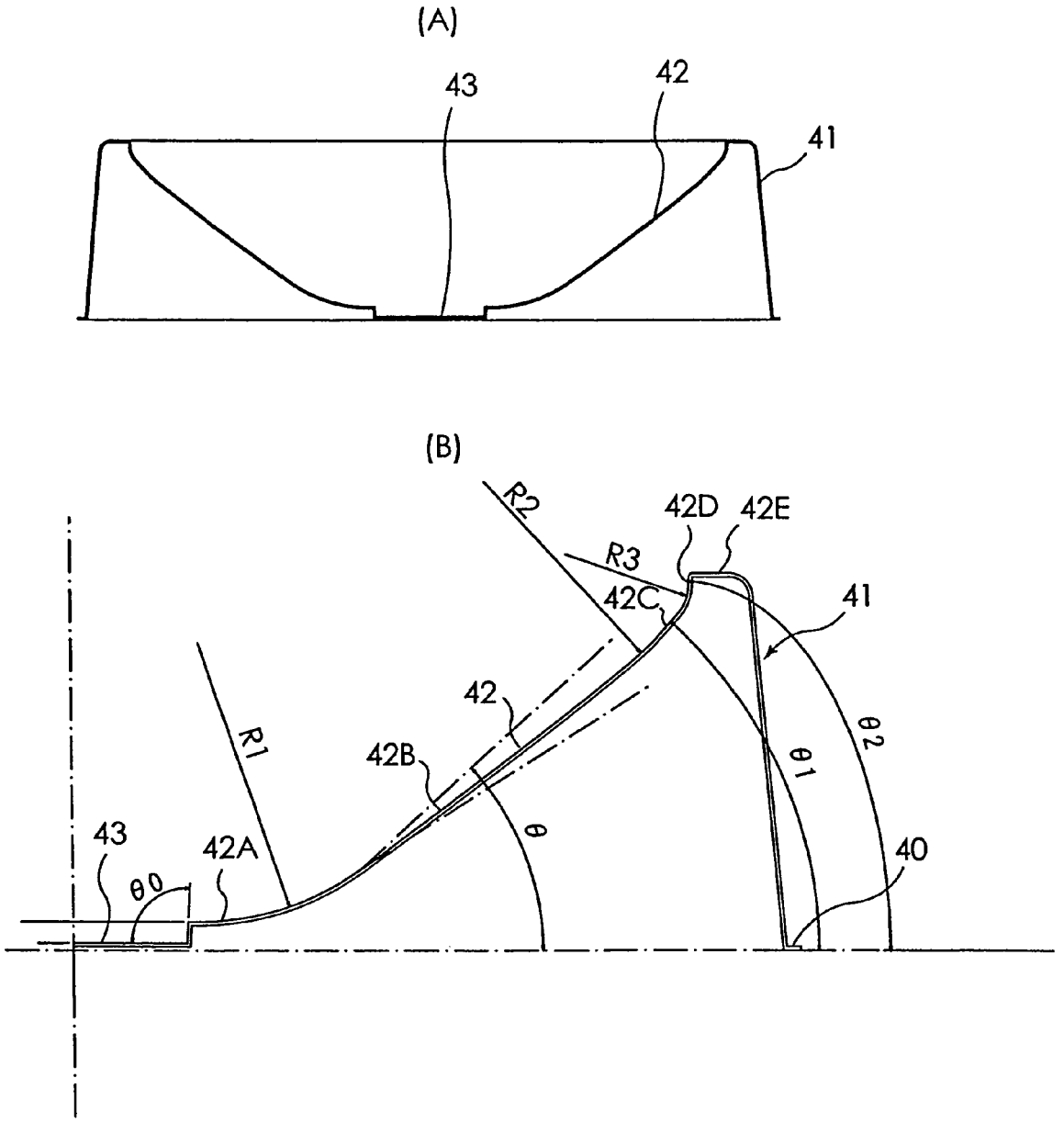
FIG. 6(A) is a sectional view through a VIA-VIA line in FIG. 5(C)
FIG. 6(B) is a diagram showing details of an enlarged sectional view of a half part of the play board.

FIGS. 5(A) through 5(C) are a perspective view, a front view, and a plan view of a play board 41 used in this embodiment. Then, FIG. 6(A) is a sectional view through a VIA-VIA line in FIG. 5(C). FIG. 6(B) shows details of a sectional view showing a half part of the play board 41. In this play board 41, a travel surface 42 is shaped to be continuous in a circumferential direction thereof and have its height from an installation surface 40 decreasing toward the central portion thereof. Then, in the central portion thereof is formed a concave section 43 with a size fully receiving the remote-controlled traveling toy 1 and with a depth allowing the remote-controlled traveling toy 1 to get out of there by itself. This concave section 43 may be the one with the size fully receiving the front wheel 5 and/or the rear wheels 7 and 9 and with the depth from which the remote-controlled traveling toy 1 can get out by itself, and is not limited to this example. When such the concave section 43 is formed in the central portion and one of the rear wheels 7 and 9 falls into the concave section 43, the remote-controlled traveling toy 1 may abruptly make a reversed movement, so that a more unexpected movement can be given to the remote-controlled traveling toy 1. Further, depending on the size and depth of the concave section 43 and the speed of the remote-controlled traveling toy 1, the remote-controlled traveling toy 1 falls into a state in which the toy is incapable of traveling or incapable of getting out of the concave section 43. In other words, this is when the front wheel 5 and all of the rear wheels 7 and 9 have fallen into the concave section 43 and the speed of the remote-controlled traveling toy 1 cannot be increased to a necessary and sufficient speed or when the body 3 or an exterior attached to the body 3 is caught by the inner wall of the concave section and advancement cannot be made with part or all of the wheels 5, 7 and 9 fallen into the concave section 43.

Assume that an angle $\theta_0$ between the inner periphery surface of the concave section 43 and the installation surface 40 is set in the angle range of 93±1° as shown in FIG. 6(B). Then, it is probable that an unexpected movement will be generated when one of the rear wheels 7 and 9 has fallen into the concave section 43.

Further, the travel surface 42 includes a first inclined surface 42A adjacent to the concave section 43 and having a first radius of curvature R1 (118.5), a second inclined surface 42B continuous with the outside of the first inclined surface 42A and having a second radius of curvature close to infinity, a third inclined surface 42C continuous with the outside of the second inclined surface 42B and having a third radius of curvature R2 (98.5) smaller than the first radius of curvature, and a fourth inclined surface 42D continuous with the outside of the third inclined surface 42C and having a fourth radius of curvature R3 (18.5) smaller than the third radius of curvature. Then, in this embodiment, width sizes (or the sizes in the slope ascending direction) of the first, second, third, and fourth inclined surfaces are set to become smaller in the order of the second inclined surface 42B, first inclined surface 42A, third inclined surface 42C, and fourth inclined surface 42D. Then, an angle 6 of the second inclined surface 42B from the installation surface 40 is set in the angle range of 32.2° to 42.2°. Specifically, this angle is set to 37.2°.

Preferably, an angle θ1 between the third inclined surface 42C and the installation surface 40 is set in the angle range of 48±2°, and an angle θ2 between the fourth inclined surface 42D and the installation surface 40 is set in the angle range of 89±1°. Further, in this embodiment, substantially a horizontal surface 42E is provided outside the fourth inclined surface 42D.

When the travel surface 42 is determined as described above, an unexpected or unpredictable movement can be made by the remote-controlled traveling toy 1.

Figure 7:
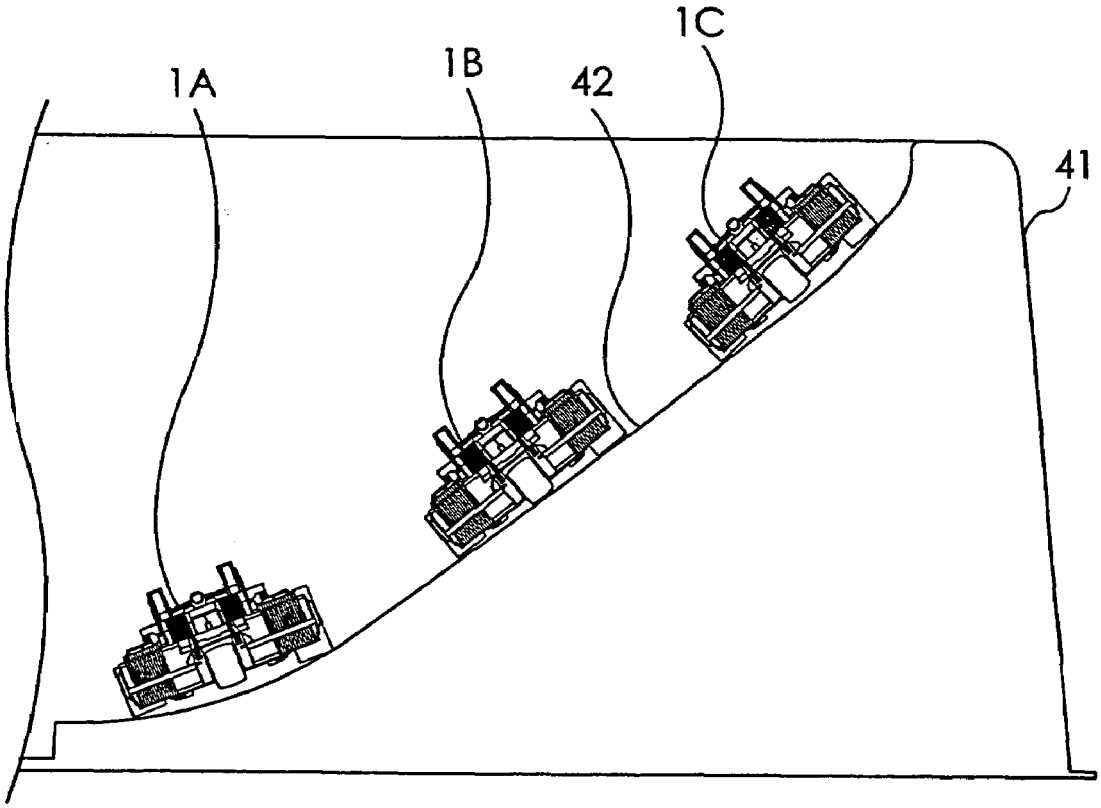
FIG. 7 is a diagram showing a state in which the remote-controlled traveling toys in this embodiment are placed on the travel surface of the play board.

FIG. 7 shows a state in which the remote-controlled traveling toys 1 in this embodiment are placed on the travel surface 42 of the play board 41. Respective remote-controlled traveling toys 1A to 1C are inclined relative to the inclined surface differently. These inclinations give the remote-controlled traveling toys an unexpected movement.

Figure 8:
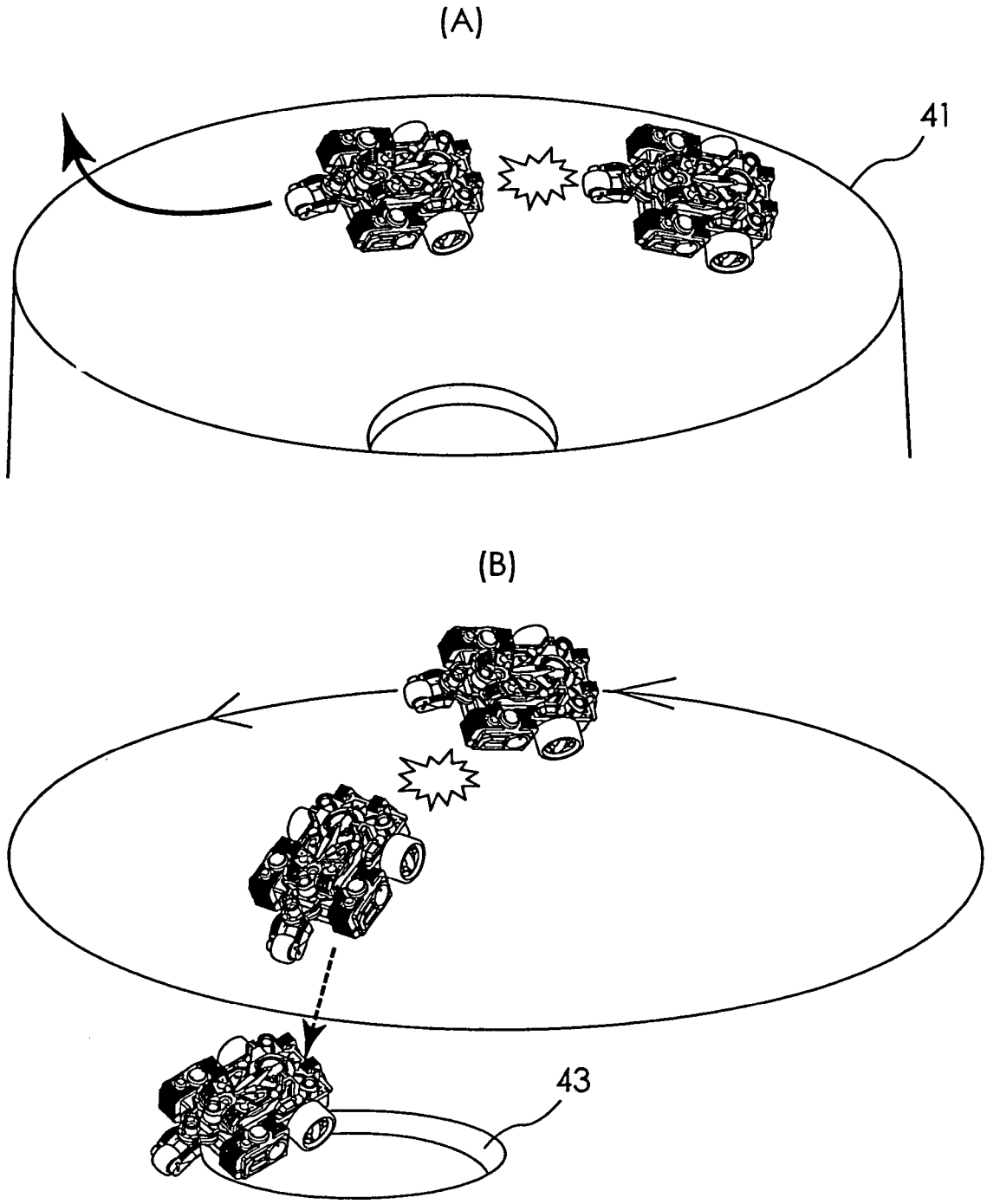
FIGS. 8(A) and 8(B) are diagrams used for explaining examples of a method of playing with the play toy system using the remote-controlled traveling toy in this embodiment, respectively.

When playing with the play toy system in this embodiment, a case where the remote-controlled traveling toy of an opponent is hit from the side or behind and pushed out of the play board 41, as shown in FIG. 8(A), for example, may be defined as a victory. Alternatively, a case where the remote-controlled traveling toy of the opponent is knocked off into the concave section 43 in the center of the travel surface and cannot get out of the concave section 43 as shown in FIG. 8(B) may be defined as the victory. A victory criterion may be defined arbitrarily.

Incidentally, in this embodiment, the electric motor, front wheel, rear wheel, and exterior parts are attached so as to enable replacement. Accordingly, if these parts are replaced for play according to a strategy, the interest of the players is more enhanced.

In the embodiment described above, the concave section 43 with a circular sectional shape was employed. The sectional shape of the concave section 43 is not limited to the circular one, and the one with an oval sectional shape or other sectional shape may be of course employed.

The present invention is configured based on a technical concept in which the diameters of some wheels among a plurality of wheels of the traveling toy may be different, and accordingly the body of the traveling toy may be inclined so that unexpected traveling is obtained. This technical concept can be naturally applied to traveling toys with four wheels or more wheels as well as traveling toys with three wheels.

INDUSTRIAL APPLICABILITY

When the diameter sizes of the two rear wheels of the remote-controlled traveling toy are made to be different and only one wheel is used as the front wheel, as in the present invention, the remote-controlled traveling toy can be caused to make an unexpected movement that has not been experienced before, depending on the state of the travel surface. Thus, compared with a mere remote control, the player can enjoy playing with the remote-controlled traveling toy which can make the unexpected movement even though the remote-controlled traveling toy can be controlled. Especially if this unexpectedness is actively used not only when competing with the remote-controlled traveling toy of an opponent but also when escaping from the toy of the opponent, the advantage of experiencing a thrilling play can be obtained.

Further, by employing as the remote control device the simple remote control device equipped with the switch to be operated for outputting a signal for rotating the electric motor at a normal speed and the acceleration switch to be operated for outputting an acceleration signal for rotating the electric motor at a speed faster than the normal speed, an advantage can be obtained that controllability will be scarcely reduced even if the remote-controlled traveling toy makes an unexpected movement and even if the remote-controlled traveling toy achieves speeding up.

Further, when the electric motor and one or more batteries connected to the electric motor are mounted onto the body of the traveling toy and the one or more batteries are juxtaposedly arranged so that the longitudinal axes thereof cross the central line of the body that extends in the longitudinal direction of the body, not only the center of gravity is lowered, but also a stable operation with respect to the lateral movement of the body can be obtained. Accordingly, even when inclination of the travel surface of the play board is steep or complicated, another advantage is obtained that tumbling will not occur readily and unexpected yet stable traveling can be obtained.

Further, when the front wheel of the remote-controlled traveling toy is formed of polyolefin including at least low-density polyethylene, the surface roughness of the front wheel of the remote-controlled traveling toy becomes coarse. Thus, the friction coefficient of the front wheel is more increased than in a case where no low-density polyethylene is included. Thus, the controllability of the remote-controlled traveling toy can be maintained.

The invention claimed is:

1. A play toy system using a remote-controlled traveling toy, comprising:

a remote control device for outputting a remote control signal;

a remote-controlled traveling three-wheeled toy having only one front wheel, only two rear wheels, and an electric motor remote controlled by said remote control signal; and a play board having a travel surface on which said remote-controlled traveling toy travels;

wherein diameter sizes of said two rear wheels of said remote-controlled traveling toy are different;

wherein said play board is shaped so that said travel surface is continuous in a circumferential direction thereof and a height thereof from an installation surface is decreasing toward a central portion thereof; and in said central portion thereof is formed a concave section with a size capable of fully receiving said front wheel and/or said rear wheels and a depth allowing said remote-controlled traveling toy to get out of there by itself.

2. The play toy system using a remote-controlled traveling toy according to claim 1, wherein an angle between an inner periphery surface of said concave section and said installation surface is set to an angle range of 93±1°.

3. The play toy system using a remote-controlled traveling toy according to claim 1, wherein a main portion of said travel surface comprises a first inclined surface adjacent to said concave section and having a first radius of curvature and a second inclined surface continuous with an outside of said first inclined surface and having a second radius of curvature close to infinity; and an angle of said second inclined surface from said installation surface is set in the angle range of 32.2° to 42.2°.

4. The play toy system using a remote-controlled traveling toy according to claim 1, wherein said travel surface comprises a first inclined surface adjacent to said concave section and having a first radius of curvature, a second inclined surface continuous with an outside of said first inclined surface and having a second radius of curvature close to infinity, a third inclined surface continuous with an outside of said second inclined surface and having a third radius of curvature smaller than the first radius of curvature, and a fourth inclined surface continuous with an outside of said third inclined surface and having a fourth radius of curvature smaller than the third radius of curvature;

width sizes of said first, second, third, and fourth inclined surfaces become smaller in an order of said second inclined surface, said first inclined surface, said third inclined surface, and said fourth inclined surface; and an angle of said second inclined surface from said installation surface is set in the angle range of 32.2° to 42.2°.

5. The play toy system using a remote-controlled traveling toy according to claim 4, wherein an angle between said third inclined surface and said installation surface is set in an angle range of 48±2°; and an angle between said fourth inclined surface and said installation surface is set in an angle range of 89±1°.

6. The play toy system using a remote-controlled traveling toy according to claim 5, wherein a substantially horizontal surface is provided outside said fourth inclined surface.

7. A play board having a travel surface on which a remote-controlled traveling three-wheeled toy travels, wherein said toy has only one front wheel, only two rear wheels, and an electric motor remotely controlled by a remote control signal, said travel surface is shaped to be continuous in a circumferential direction thereof and have a height thereof from an installation surface is decreasing toward a central portion thereof; and in said central portion thereof is formed a concave section with a size capable of fully receiving said front wheel and/or said rear wheels and a depth allowing said remote-controlled traveling toy to get out of there by itself.

8. The play toy system using a remote-controlled traveling toy according to claim 2, wherein a main portion of said travel surface comprises a first inclined surface adjacent to said concave section and having a first radius of curvature and a second inclined surface continuous with an outside of said first inclined surface and having a second radius of curvature close to infinity; and an angle of said second inclined surface from said installation surface is set in the angle range of 32.2° to 42.20°.

9. The play toy system using a remote-controlled traveling toy according to claim 2, wherein said travel surface comprises a first inclined surface adjacent to said concave section and having a first radius of curvature, a second inclined surface continuous with an outside of said first inclined surface and having a second radius of curvature close to infinity, a third inclined surface continuous with an outside of said second inclined surface and having a third radius of curvature smaller than the first radius of curvature, and a fourth inclined surface continuous with an outside of said third inclined surface and having a fourth radius of curvature smaller than the third radius of curvature;

width sizes of said first, second, third, and fourth inclined surfaces become smaller in an order of said second inclined surface, said first inclined surface, said third inclined surface, and said fourth inclined surface; and an angle of said second inclined surface from said installation surface is set in the angle range of 32.2° to 42.2°.

* * * * *